US006135071A

United States Patent [19]

Kobayashi et al.

[11] Patent Number: 6,135,071

[45] **Date of Patent: *Oct. 24, 2000**

[54] TWO-STROKE INTERNAL COMBUSTION ENGINE

[75] Inventors: Fujio Kobayashi; Katsuya Tajima, both of Tokyo, Japan

[73] Assignee: Kioritz Corporation, Tokyo, Japan

[ * ] Notice: This patent is subject to a terminal disclaimer.

[21] Appl. No.: 09/018,739

[22] Filed: Feb. 4, 1998

[30] Foreign Application Priority Data

Feb. 10, 1997 [JP] Japan ..... 9-026437

[51] Int. Cl.[7] ..... F02B 33/04

[52] U.S. Cl. ..... 123/73 A; 123/73 R; 123/73 B; 123/73 PP

[58] Field of Search ..... 123/73 R, 73 A, 123/73 B, 73 PP

[56] References Cited

U.S. PATENT DOCUMENTS 4,711,225 12/1987 Holderle et al. ..... 123/590
4,776,302 10/1988 Hundertmark et al. ..... 123/41.39
4,776,303 10/1988 Hundertmark ..... 123/41.84
5,040,496 8/1991 Plohberger et al. ..... 123/65 PD
5,503,119 4/1996 Glover ..... 123/73 B
5,727,506 3/1998 Tajima et al. ..... 123/73 A

*Primary Examiner*—Henry C. Yuen
*Assistant Examiner*—Hai Huynh
*Attorney, Agent, or Firm*—Baker & Botts, L.L.P.

[57] ABSTRACT

A two-stroke internal combustion engine having a crankcase provided with a crank chamber, a suction port which opens to the crank chamber, a scavenging passage opening into the crank chamber, and a crankshaft is provided with a flow control surface formed on an inner peripheral wall portion of the crank chamber which is capable of retarding the flow rate of unatomized raw fuel and which extends from the vicinity of the suction port to the vicinity of the scavenging passage. The flow control surface is comprised of a large number of intersecting unit ribs.

4 Claims, 4 Drawing Sheets

TWO-STROKE INTERNAL COMBUSTION ENGINE

BACKGROUND OF THE INVENTION

1. Field of the Invention

The present invention relates to a two-stroke internal combustion engine, and in particular to a two-stroke internal combustion engine which is suited for use in a portable working machine, such as a chain saw, that is adapted to be operated in various handling postures.

2. The Prior Art

An air-cooled two-stroke gasoline engine of small in size is generally constructed such that an air/fuel mixture is sucked via an inlet port into a crank chamber, in which the air/fuel mixture is pre-compressed and at the same time agitated by a balance weight rotating in the crank chamber. In such engines, a portion of unatomized raw fuel in the sucked air/fuel mixture is sometimes unintentionally fed via a scavenging passage into the combustion chamber. This phenomenon can be seen more frequently when the engine is in a state of idling.

When the engine is in a state of high load and high rotational speed, the quantity of fuel per unit time is relatively large. In this state, even if the unatomized raw fuel flows in a rush into the combustion chamber, no serious inconvenience results. However, when the engine is in a state of idling, the quantity of fuel per unit time is relatively small. If, in such circumstances, the unatomized raw fuel is allowed to flow in a rush into the combustion chamber, the air/fuel mixture becomes excessive in concentration, and results in a serious problem, e.g. stalling and stoppage of the engine.

An air-cooled two-stroke gasoline engine of small in size (hereinafter referred to simply as an internal combustion engine or an engine) which is commonly employed as a power source for a portable working machine to be operated in various handling postures, such as a chain saw, is generally arranged so as to be oriented horizontally in a main case or housing during use. The engine is typically elongated, i.e. larger in the longitudinal direction (height) than in the lateral direction. Due to this structure of the internal combustion engine, the aforementioned phenomenon becomes more prominent, resulting in the sudden stalling and stoppage of the engine.

In the case of the aforementioned small two-stroke internal combustion engine which is adapted to be disposed horizontally in a main case of a working machine, such as a chain saw (as disclosed, for example, in Japanese Utility Model Unexamined Publication S/56-140402), a suction port is formed at the bottom (a side portion when viewed in a horizontal posture) of the crank chamber and an air/fuel mixture from a carburetor is sucked from the suction port via a reed valve to the crank chamber to be pre-compressed therein, the resultant pre-compressed air/fuel mixture then being transferred through a scavenging passage to the combustion chamber. Heretofore, there has frequently been experienced a phenomenon of sudden stalling of the engine, resulting in the stoppage of engine, when the forward portion of the working machine (e.g., chain saw) is directed upward or obliquely upward after the working machine has been operated with the forward portion thereof directed downward or obliquely downward for a period of time.

The cause of this phenomenon can be explained as follows. Namely, an unatomized raw fuel (a liquid fuel) which has been adhered or collected at first on the inner peripheral wall of the crank chamber of the engine collectively flows into the suction port to be accumulated therein during a period when the forward portion of the working machine is directed downward or obliquely downward, i.e. when the suction port which opens to the crank chamber of the engine is directed downward or obliquely downward. When the forward portion of the working machine is thereafter directed upward or obliquely upward, the unatomized fuel that has been accumulated in the suction port flows into the scavenging passage along the inner peripheral wall of the crank chamber and then flows in a rush into the combustion chamber from the scavenging passage, thereby supplying an excessively concentrated air/fuel mixture to the combustion chamber for combustion.

In an attempt to prevent this undesirable flow of unatomized raw fuel in the crank chamber due to the change in handling posture of engine, the assignee of the present invention have proposed in Japanese Patent Application H/7-313371 the installation of a flow control portion or structure at the inner peripheral wall of the crank chamber.

According to this proposal, a flow control portion or structure consisting of one or two dams, grooves or recesses is installed near the inlet port of the crank chamber for interrupting the flow of the unatomized raw fuel, thus preventing the unatomized raw fuel from entering into the combustion chamber even if the unatomized raw fuel accumulated at the inlet port is forced to flow into the crank chamber due to a change in handling posture of the engine.

However, since the dams and the like functioning as a flow control structure are formed in the vicinity of the inlet port in parallel with the crank shaft according to the aforementioned proposal, it has heretofore been difficult to prevent the inflow into the combustion chamber of unatomized raw fuel that adheres to an inner wall portion of the crank chamber on the scavenging passage side of such dams or flow control structure before the engine is changed in handling posture, or the inflow into the combustion chamber of the unatomized raw fuel that passes over the dams or flow control structure on the occasion of change in handling posture of the engine.

SUMMARY OF THE INVENTION

The present invention has been made under the circumstances mentioned above. It is therefore an object of the present invention to provide a two-stroke internal combustion engine which is capable of inhibiting the undesirable flow of unatomized raw fuel that has adhered to the inner peripheral wall of the crank chamber even if the handling posture of the internal combustion engine of a working machine is changed due to a change in handling posture of the working machine, thereby preventing the in-rush of unatomized raw fuel into the combustion chamber and the resulting undesired stoppage of the engine.

According to the present invention, there is provided a two-stroke internal combustion engine comprising a crankcase provided with a crank chamber and a suction port which opens to the crank chamber, wherein a flow control surface that is capable of retarding the flow rate of unatomized raw fuel is formed on an inner peripheral wall portion of the crank chamber, such flow control surface extending from the vicinity of the suction port to the vicinity of a scavenging passage.

According to a preferred embodiment of the present invention, the flow control surface is formed of a lattice-like rib structure made up of a large number of unit ribs which intersect in a lattice-like form. Preferably, the unit ribs are divided into two groups that are oriented at predetermined intersecting angles to the axis of the crankshaft and extend over the entire width of the crank chamber.

According to the two-stroke internal combustion engine of the present invention, as described above, when the cylinder head of the engine is directed upward due to a change in posture of the portable working machine containing the engine, the unatomized raw fuel that has adhered to the flow control surface formed on the inner peripheral wall of the crank chamber is constrained to flow slowly towards the suction port while crossing over a large number of unit ribs of the flow control surface and is gradually dispersed and collected in a large number of concavities, formed by the intersecting unit ribs.

Subsequently, when the handling posture of the engine is suddenly changed and directed toward the opposite direction (upward direction), the unatomized raw fuel which has been collected at the suction port and in the concavities tends to flow in a rush towards the scavenging passage. However, the in-rush of the unatomized raw fuel is intercepted by the large number of unit ribs of the lattice-like rib structure, and the flow rate of the unatomized raw fuel is thus greatly reduced. The unatomized raw fuel is thus retained in the concavities surrounded by the inclined unit ribs, thereby making it possible to easily re-atomize the unatomized raw fuel.

As for the unatomized raw fuel that has adhered to the flow control surface or other inner wall portions of the crank chamber before the handling posture of the engine is changed to the opposite direction, it is also prevented from rushing in a liquid state, via the inner peripheral wall of the crank chamber, into the combustion chamber even if the handling posture of the engine is suddenly changed in the opposite direction, thus minimizing any possibility of an unexpected stoppage of the engine.

DESCRIPTION OF THE PREFERRED EMBODIMENT OF THE INVENTION

The present invention will be further explained with reference to the drawings depicting one embodiment of a two-stroke internal combustion engine according to the present invention.

Figure 1:
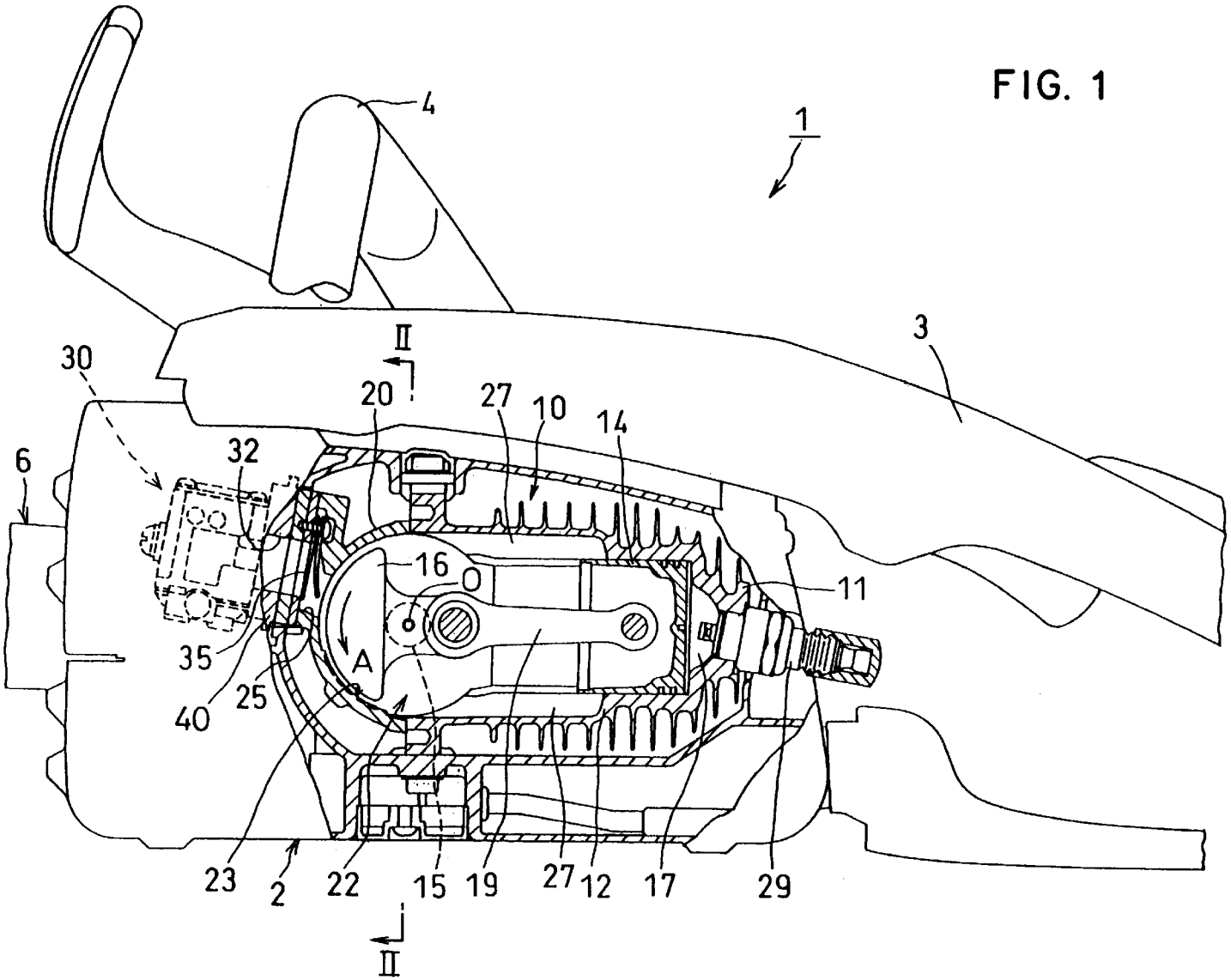
FIG. 1 is a partial side sectional view illustrating one embodiment of a two-stroke internal combustion engine according to the present invention, with parts broken away for clarity.

FIG. 1 shows a chain saw 1 representing one example of a portable power working machine, provided with a two-stroke internal combustion engine according to the present invention.

As illustrated, the chain saw 1 comprises a main case 2, a working member 6 such as a saw chain which is detachably mounted on the forward portion (the left side in FIG. 1) of the main case 2, a main handle 3 attached to the rearward portion of the main case 2, and a loop auxiliary handle 4, which is attached to the upper forward portion of the main case 2.

An air-cooled two-stroke gasoline engine 10 of small in size according to this embodiment is housed in the main case 2 in such a manner that the engine 10 is oriented substantially horizontally with the cylinder head 11 thereof directed rearward, i.e. a cylinder block 12 is disposed on the rear side and a crankcase 20 connected with the cylinder block 12 is disposed on the forward side of the main case 2.

A piston 14 is received in the cylinder block 12. A combustion chamber 17 is defined above (to the right in FIG. 1) of the top face of the piston 14. An ignition plug 29 is attached to the cylinder head 11 of the cylinder block 12, with the tip end thereof protruding into the combustion chamber 17.

The reciprocating movement of the piston 14 is converted via a connecting rod 19 into rotational movement of a crank shaft 15 which is axially supported by a bearing (not shown) disposed between the semi-circular crankcase 20 and the lower portion of the cylinder block 12. When the crank shaft 15 is rotated in this manner, the balance weight 16 attached to the crank shaft 15 is concurrently caused to rotate within a crank chamber 22 defined between the crankcase 20 and the lower portion of the cylinder block 12 and in the direction indicated by the arrow A in FIG. 1.

A suction port 25 is formed at a portion of the crankcase 20 which is located on the upper side of the bottom of the crank chamber 22 (or the forward portion as viewed in the horizontal orientation of the engine as shown in FIG. 1).

An air/fuel mixture supplied from a diaphragm type carburetor 30 is transferred into a supply passage 32 formed in an insulator 40 and is then introduced into the suction port 25. The air/fuel mixture thus introduced into the suction port 25 via a reed valve 35 is sucked and pre-compressed in the crank chamber 22, the resultant pre-compressed air/fuel mixture being subsequently introduced, via the upper and lower scavenging passages 27, 27 communicating with the crank chamber 22, into the combustion chamber 17 as the piston 14 reciprocates.

Figure 2:
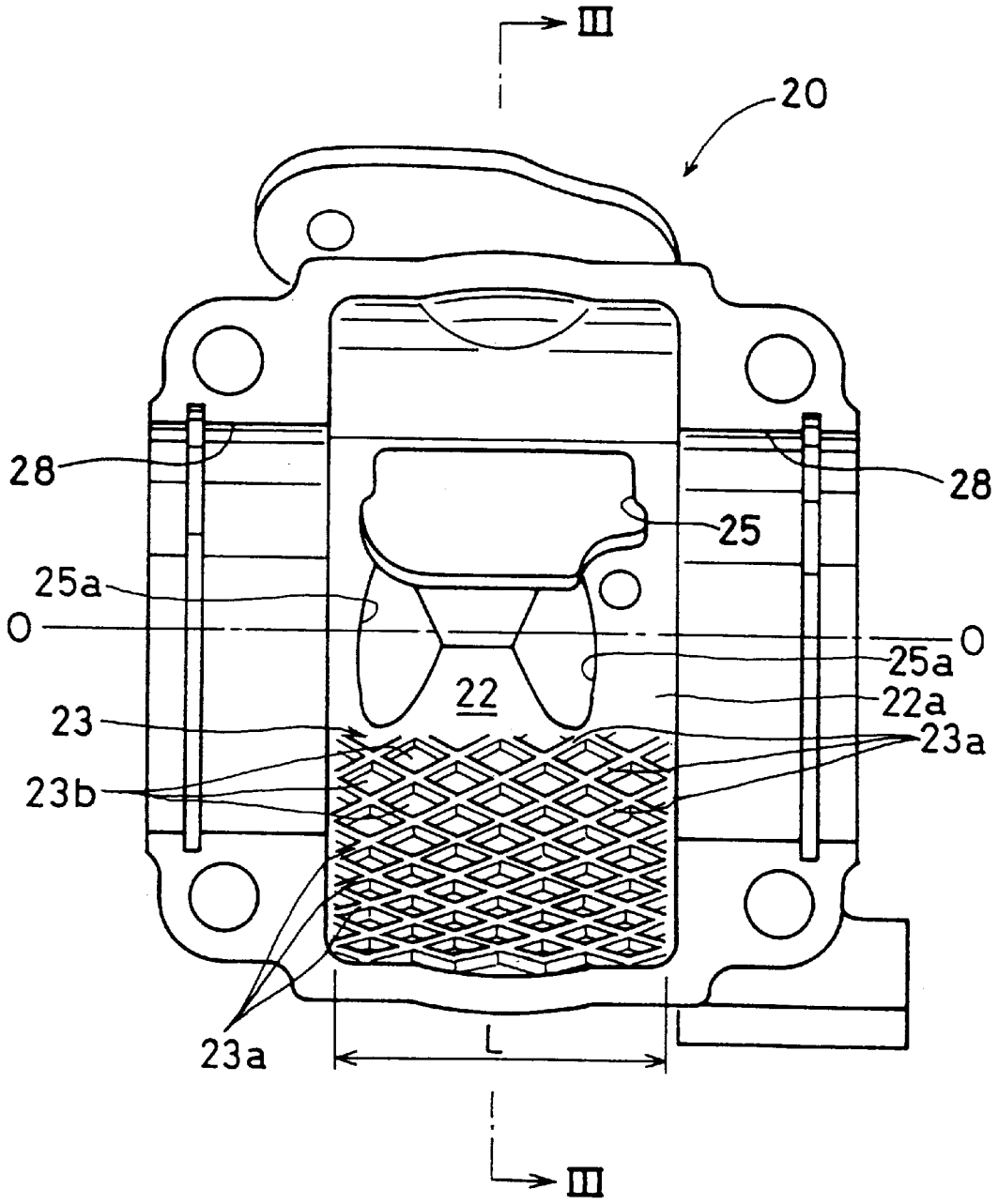
FIG. 2 is an enlarged sectional view taken along the line II—II of FIG. 1, illustrating the crankcase of the two-stroke internal combustion engine.
Figure 3:
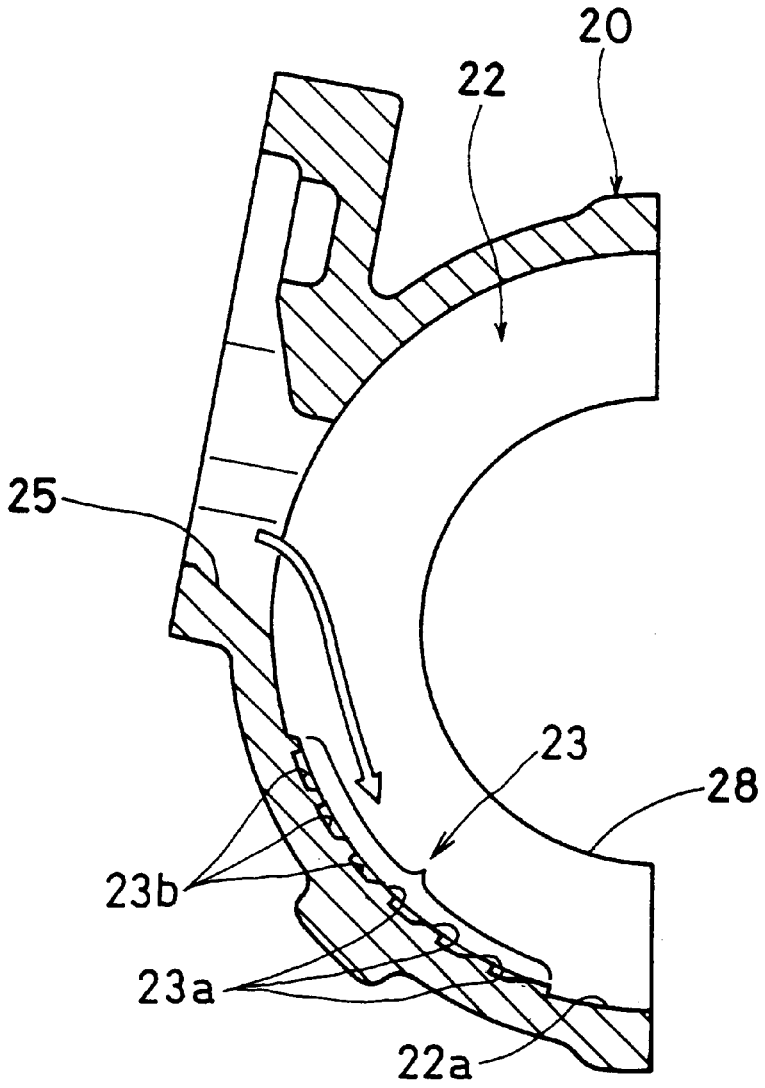
FIG. 3 is a longitudinal sectional view taken along the line III—III of FIG. 2.

As clearly seen from FIGS. 2 and 3, a flow control surface 23, which is capable of retarding the flow of unatomized raw fuel, is formed along an inner peripheral wall portion 22*a* of the crank chamber 22 that extends from the vicinity of the suction port 25 to the vicinity of the lower scavenging passage 27. More specifically, this flow control surface 23 is formed of a lattice-like rib structure constituted by a large number of unit ribs 23*a* that intersect in a lattice-like form and extend over the entire width L of the crank chamber 22 in the direction of axis O—O of the crank shaft 15.

Figure 4:
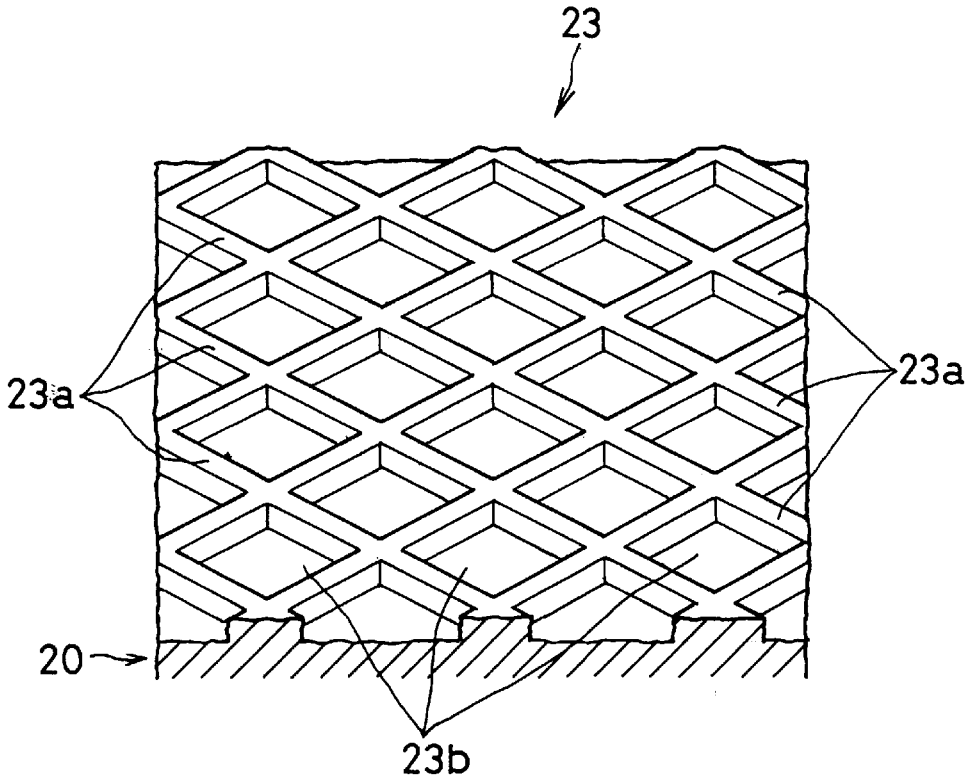
FIG. 4 is an enlarged perspective view of the flow control surface formed on the inner peripheral wall of the crankcase shown in FIG. 2.

The unit ribs 23*a* are arranged in two groups aligned in different directions, whereby the two groups of unit ribs intersect with each other and form a lattice. Furthermore, since the two groups of unit ribs 23*a* are inclined at the same predetermined angle (but in opposite directions) to the axis O—O of the crankshaft 15, the intersecting ribs 23*a* form a plurality of a rhomboid-like concavities 23*b* surrounded by ribs 23*a*, as shown in FIG. 4. The reference numeral 28 in FIGS. 2 and 3 denotes a mounting portion of the bearing for the crankshaft 15.

Next, the operation of a chain saw 1 provided with a two-stroke internal combustion engine 10 having the aforementioned structure will be explained. When the chain saw 1 is operated for a time with its forward portion directed downward or obliquely downward, the unatomized raw fuel that has adhered or collected in the concavities 23*b* of the flow control surface 23 formed on the inner peripheral wall 22*a* of the crank chamber 22 flows slowly towards the suction port 25 while crossing over a large number of unit ribs 23*a* of the flow control surface 23 and is gradually dispersed and collected in the large number of concavities 23*b*, each being surrounded by the intersecting unit ribs 23*a*.

Subsequently, when the forward portion of the chain saw 1 is suddenly directed upward or obliquely upward, the unatomized raw fuel that has been retained at the suction port 25 is caused to flow toward the lower scavenging passage 27, as shown by a white arrow in FIG. 3. However, such flow of the unatomized raw fuel is intercepted by the large number of unit ribs 23*a* of the flow control surface 23, with the result that the flow rate of the unatomized raw fuel is greatly reduced and the unatomized raw fuel is dispersed among the concavities 23*b* surrounded by the inclined ribs 23*a*. This makes it possible to easily re-atomize the unatomized raw fuel.

As for the unatomized raw fuel that has already adhered to the flow control surface 23 or other inner wall portion 22*a* of the crank chamber 22 before the handling posture of the engine 10 is changed by the upward or obliquely upward inclination of the forward portion of the chain saw 1, such raw fuel is also prevented by the lattice-like rib structure from rushing in a liquid state, via the inner peripheral wall 22*a* of the crank chamber 22, into the combustion chamber 17 even if the handling posture of the engine 10 is suddenly changed, thus minimizing any possibility of an unexpected stalling and stoppage of the engine 10.

In the foregoing explanation, the present invention has been explained with reference to one embodiment. It will be understood, however, that the present invention is not limited to such embodiment, but may be variously modified within the spirit and scope of the invention as defined in the claims.

For example, the two groups of unit ribs 23*a* of the flow control surface 23 are shown in the drawings as inclined by equal, but opposite, angles to the direction of axis O—O of the crank shaft 15. Alternatively, one of the groups of ribs 23*a* of the flow control surface 23 may be set parallel to the axial direction of the crank shaft 15, while the other group of ribs 23*a* may be set perpendicular to the axial direction of the crank shaft 15.

Furthermore, as shown in FIG. 2, it may be preferable to provide flow-separating grooves 25*a* in the vicinity of the suction port 25 to prevent the unatomized raw fuel from forming a convergent flow.

As may be seen from the foregoing explanation, a lattice-like flow control surface comprised of a large number of unit ribs is formed on an inner peripheral wall portion of the crank chamber in such a manner that it extends from vicinity of the suction port to the vicinity of a scavenging passage. According to the present invention, therefore, it is possible to inhibit the unatomized raw fuel that has collected or adhered at the suction port from entering into the crank chamber upon the occurrence of changes in handling posture of the engine. Because such an undesirable flow of unatomized raw fuel is intercepted by the large number of unit ribs, and hence reduced in flow rate and dispersed over a large number of concavities, each encircled by the ribs, the unatomized raw fuel is prevented from flowing in a rush into the combustion chamber, thereby making it possible to easily re-atomize the unatomized raw fuel. As a result, accidental stalling and stoppage of the engine is prevented.

We claim:

1. A two-stroke internal combustion engine, comprising;

a crankcase provided with a crank chamber, a suction port which opens to the crank chamber, a scavenging passage which opens to the crank chamber at a location spaced along an inner peripheral wall of said crank chamber from said suction port, and a crankshaft having an axis of rotation; and a flow control surface formed on an inner peripheral wall portion of said crank chamber for retarding the flow rate of unatomized raw fuel, said flow control surface extending from the vicinity of said suction port to the vicinity of said scavenging passage opening to the crank chamber.

2. The two-stroke internal combustion engine according to claim 1, wherein said flow control surface is formed of a large number of unit ribs.

3. The two-stroke internal combustion engine according to claim 2, wherein said large number of unit ribs is formed into a lattice-like pattern.

4. The two-stroke internal combustion engine according to claim 3, wherein:

said large number of unit ribs is divided into two groups that are oriented at respective predetermined angles to the axis of the crankshaft to form said lattice-like pattern; and said lattice-like pattern extends over the entire width of the crank chamber in the direction of the crankshaft axis.

* * * * *